US008939163B2

(12) United States Patent
Gray

(10) Patent No.: US 8,939,163 B2
(45) Date of Patent: Jan. 27, 2015

(54) UMBRELLA ANTI-INVERSION APPARATUS

(71) Applicant: Aubrey Michael Gray, Lilburn, GA (US)

(72) Inventor: Aubrey Michael Gray, Lilburn, GA (US)

( * ) Notice: Subject to any disclaimer, the term of this patent is extended or adjusted under 35 U.S.C. 154(b) by 12 days.

(21) Appl. No.: 13/862,397

(22) Filed: Apr. 13, 2013

(65) Prior Publication Data

US 2014/0283888 A1 Sep. 25, 2014

Related U.S. Application Data

(60) Provisional application No. 61/741,653, filed on Jul. 25, 2012.

(51) Int. Cl.
*A45B 25/22* (2006.01)
*A45B 25/00* (2006.01)

(52) U.S. Cl.
CPC ..... *A45B 25/22* (2013.01); *A45B 25/00* (2013.01)
USPC ..... 135/27

(58) Field of Classification Search
CPC ..... A45B 25/22
USPC ..... 135/27
See application file for complete search history.

(56) References Cited

U.S. PATENT DOCUMENTS

| | | | | | |
|---|---|---|---|---|---|
| 360,294 | A * | 3/1887 | Haitz | 135/27 |
| 539,762 | A * | 5/1895 | Barnett | 135/27 |
| 1,369,996 | A * | 3/1921 | Westbeld | 135/27 |
| 2,522,645 | A * | 9/1950 | Senna | 135/27 |
| 3,032,047 | A * | 5/1962 | Wendorf | 135/33.7 |
| 3,930,514 | A * | 1/1976 | Wu | 135/27 |
| 4,407,317 | A | 10/1983 | Crandall | |
| 5,277,212 | A * | 1/1994 | Aronov | 135/27 |
| 5,794,637 | A | 8/1998 | Figueroa | |
| 6,216,712 | B1 * | 4/2001 | Lin et al. | 135/31 |
| 8,607,808 | B1 * | 12/2013 | You | 135/29 |
| 2003/0178050 | A1 * | 9/2003 | Wu | 135/32 |
| 2007/0209692 | A1 * | 9/2007 | Yu | 135/33.2 |

* cited by examiner

*Primary Examiner* — Noah Chandler Hawk

(57) ABSTRACT

The present invention includes an umbrella anti-inversion apparatus comprising a removable cuff and a plurality of removable and adjustable straps. The cuff is attached around an umbrella shaft and the straps extend radially from the strap openings on the adjustable cuff to the umbrella tips to which they are connected. There are adjusting means incorporated on to the straps enabling easy modification of length thereby providing varied tension in each strap for effectively preventing undesirable displacement of the rib outer ends; thus providing a particular means for averting the inversion of an umbrella canopy in an open position from high winds and other weather events.

17 Claims, 4 Drawing Sheets

UMBRELLA ANTI-INVERSION APPARATUS

PRIORITY CLAIM

This application claims benefit of U.S. Provisional Application No. 61/741653 filed Jul. 25, 2012.

FIELD OF INVENTION

This invention relates to attachments to an umbrella and in particular to means for preventing the inversion of an umbrella canopy from high winds and other weather events.

BACKGROUND OF INVENTION

Umbrellas are widely used to shield the user against rain and sun and other effects of the weather. There are both portable and stationary umbrellas and some umbrellas that are both portable and stationary, for example a beach umbrella that is positioned on the beach daily and remains there until it is put away in the evening. In order to be conveniently folded, carried and stored when not in use, umbrellas tend to be relatively lightweight and contain only the minimum amount of structure. Due to this construction, many umbrellas do not perform well under high winds. Without warning, a single gust of wind can cause the canopy of the umbrella to invert from its normal downwardly concave position to the opposite convex position, often damaging the umbrella so that it is no longer usable and causing the user to no longer be protected against the weather's elements.

This tendency for an umbrella to invert in high winds is exacerbated by the fact that the canopy of the typical umbrella and the ribs of the canopy are typically made of very thin, lightweight materials. Moreover, it has been the experience of the applicant that even relatively expensive umbrellas marketed as being "wind-proof" are not immune to this problem. Accordingly, there is a need for an umbrella attachment that serves to keep an umbrella's canopy intact during strong wind gusts.

One challenge that has until this point not been overcome is the fact that many users of umbrellas do not have a windproof umbrella and do not know if and when they will ever need their umbrella to be windproof. This is because weather in general and wind specifically can be very unpredictable. Even those who do purchase a wind proof umbrella, even though they may pay much more than they would for a standard umbrella, do not realize it may not completely prevent inversion because of subtle defects in the design or because it simply was not meant to meet their specific application. The physical surroundings, such as the presence of tall buildings in an urban setting, for example, can cause wind force and direction to change suddenly without warning. Also, many people who use umbrellas in the course of their business or personal travels find themselves encountering various weather conditions that make it even more difficult to know in advance how to prepare for them.

The issue of preventing umbrella inversion has been addressed by others in the past. However, their attempts have inherent shortcomings, which this invention intends to address. Some attempted solutions have tried to permanently attach such apparatuses to an umbrella, but these solutions have not sufficiently addressed the needs of the industry owing to their awkwardness and lack of portability and their inability to be used on multiple different umbrellas of the user having varying sizes.

For example, as shown in U.S. Pat. No. 4,407,317 to Crandall (hereinafter referred to as Crandall), one attempted solution to this problem was to provide an umbrella reversal prevention structure having adjustable bands attached to the center shaft of the umbrella and extending outward to the outer ends of the umbrella's canopy. The adjustable bands are set to a preselected distance to create tension to prevent the reversal of the umbrella during high wind force. Crandall teaches permanently attaching the multiple straps to the center shaft of the umbrella at a position that is above the runner of the umbrella and that is in a downward direction towards the outer portion of the canopy.

U.S. Pat. No. 5,794,637 to Figueroa (hereinafter referred to as Figueroa), describes a device to prevent inversion of an umbrella, where cords of a fixed length are mounted to a central runner of the umbrella and the ribs of the umbrella in order to maintain the concave shape and discourage the outward and upward bending of the ribs which can lead to inversion. However, the system shown in Figueroa is not removable from the umbrella and is intended to be a permanent fixture of the umbrella.

Although there have been the aforementioned and many other attempts to solve the problem of inverted umbrellas, such techniques have also failed to disclose a method of inversion prevention which can be practically retrofitted to any number of already existing umbrellas of varying sizes simply by removing, reattaching, and adjusting the apparatus.

SUMMARY OF INVENTION

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

To resolve the problems mentioned above, an object of the present invention is to provide a convenient method for preventing umbrella inversion as a result of high winds.

In one embodiment a removable cuff is attached to an umbrella utilizing the shaft and several straps connected to the tips of the umbrella. This set-up allows for the straps to be removable and adjustable thereby creating a convenient method for removal of the apparatus. In this embodiment, the apparatus is portable so that it can be transported to and used on another umbrella. However, the apparatus can also be left attached to the umbrella.

In this embodiment, the straps are adjustable to provide a means to adjust the apparatus to various sizes to accommodate various sized umbrellas.

The cuff of this apparatus is flexible, but has a ring integrated into the cuff to provide stability to the attachment point of the straps and also to provide shape to the cuff, due to its flexibility.

The cuff is attachable to an umbrella runner to provide a sturdy attachment point of the umbrella and also to provide an optimal angle of the attachment point of the straps to provide ideal force against the canopy of the umbrella to prevent inversion.

In another embodiment, the outer ends of the straps are connected to the edge of the umbrella canopy and the inner ends of the straps are attached to the openings of the cuff. The positions of the openings of the cuff are adjustable vertically along the cuff to adjust the angle formed between each of the straps and the umbrella shaft.

A further embodiment of the present invention contains the ability to alter this same angle via the vertical placement of the cuff on the shaft of the umbrella allowing for increased stability.

Another object of the present invention is to provide greater stability to the umbrella canopy when faced with high wind gusts. In this embodiment, the first end of each of a plurality of Y-shaped straps is connected to a removable cuff and each of the two opposite ends is connected to two separate tips of the umbrella canopy.

One further embodiment of the present invention involves the use of a molded plastic yet still removable cuff that incorporates many of the features of the cuff described in other embodiments above.

Still other objects of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE EMBODIMENTS

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

In the embodiments as disclosed herein, a traditional umbrella is shown for purposes of demonstrating the configuration and attachment of the anti-inversion apparatus of this invention, but it is not intended to be a part of this invention. Throughout the specification, different portions of the traditional umbrella, as described below, will be referenced for illustrative purposes.

Figure 4:
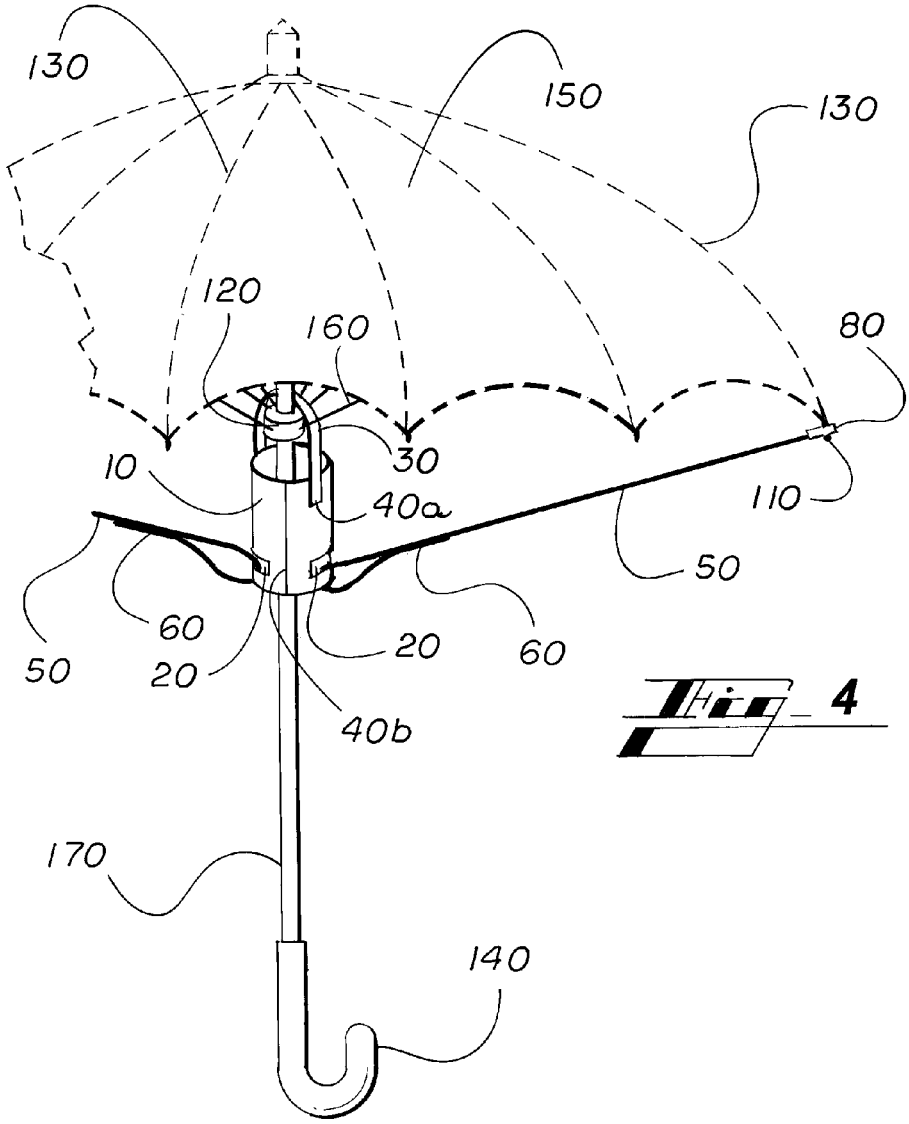
FIG. 4 is a perspective view of the anti-inversion apparatus attached to an umbrella.
Figure 5:
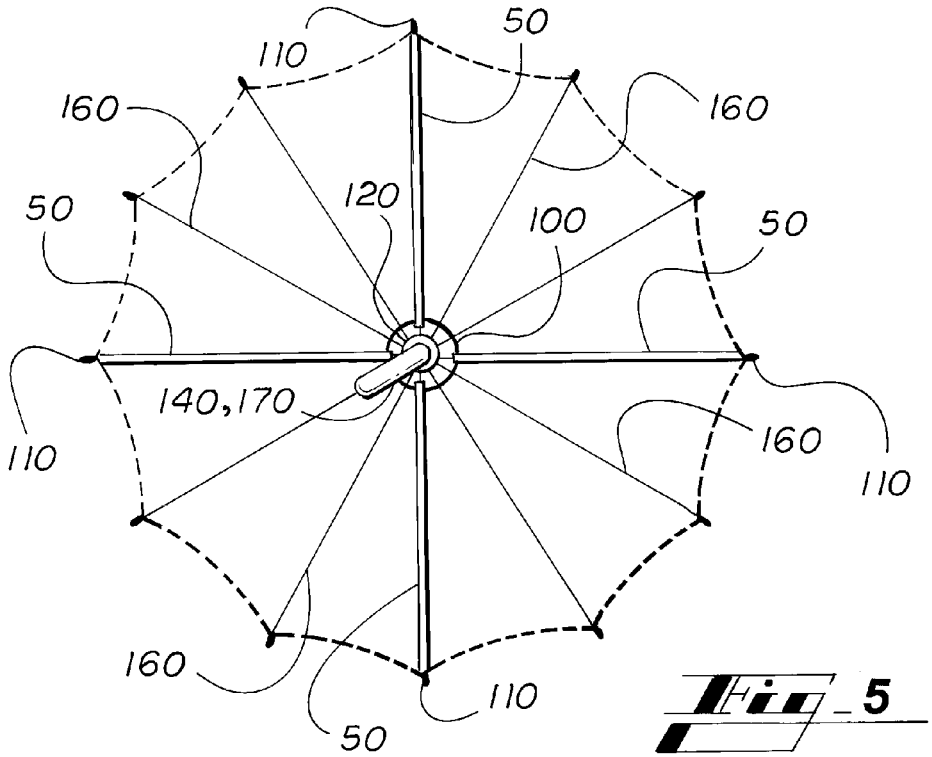
FIG. 5 is a bottom view of the anti-inversion apparatus attached to an umbrella.
Figure 6:
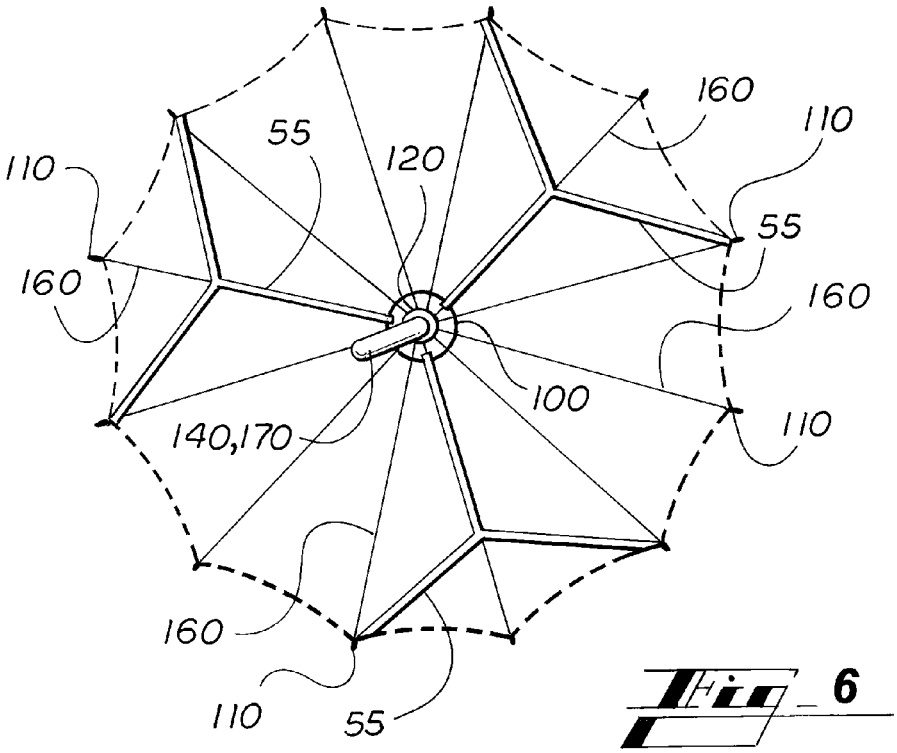
FIG. 6 is a bottom view of the anti-inversion apparatus attached to an umbrella using Y-shaped straps, in accordance to an alternate embodiment of this invention.

As specifically shown in FIGS. 4-6, a traditional umbrella contains a canopy 150, a shaft 170 and a handle 140. A runner 120 is movably mounted on the shaft 170 and is movable along the length of the shaft 170. A plurality of resilient ribs 130 are defined by stretcher(s) 160. The stretcher(s) 160 include inner ends connected to the runner 120 and outer ends connected to the ribs 130. When open, as seen in for example FIG. 4, the stretcher(s) 160 are spaced at equal angles about the axis of shaft 170. The umbrella canopy 150 is secured to the shaft 170 and to the tip(s) 110. As best seen in FIG. 4, the umbrella structure may also include a conventional spring-loaded latch for releasably retaining the runner 120 in a position wherein the stretcher(s) 160 urge the ribs 130 and canopy 150 to tighten in the open position, with the canopy 150 defining an inwardly concave configuration. Upon release of the latch, the umbrella may be folded to a closed configuration wherein the stretcher(s) 160 and canopy 150 are released and storable.

Although the umbrella described herein is used for illustration, other umbrellas configurations may be used without departing from the scope of this invention.

Figure 1:
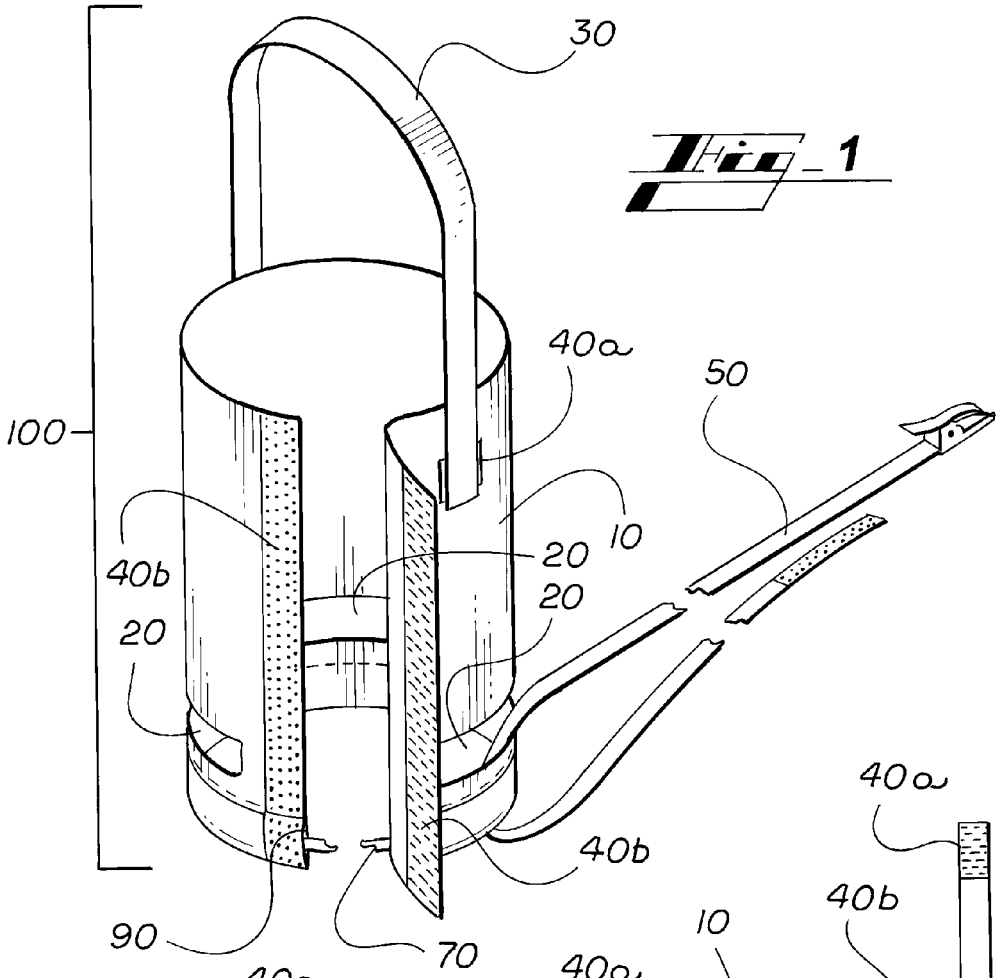
FIG. 1 is a perspective view of one embodiment of the anti-inversion apparatus of the present invention.

FIGS. 1 through 5 depict one embodiment of the anti-inversion apparatus 100 in accordance with this invention. FIG. 1 illustrates a perspective view of one embodiment of the anti-inversion apparatus 100. The anti-inversion apparatus 100 is made of a cuff 10, having strap opening(s) 20 and arching strap 30. The cuff 10 has a ring 70 integrated into it at a location that is proximal to each of the strap opening(s) 20. Strap(s) 50 are attached to the cuff 10 by looping them through the strap opening(s) 20 and around ring 70.

In this first embodiment, the cuff 10 is made of a flexible yet inelastic material such as, but not limited to, leather, vinyl, plastic, etc. It is preferred that the cuff 10 material is inelastic because, as later described, the strap(s) 50 and the arching strap 30 will place force against the cuff 10 to keep the umbrella from inverting. The cuff 10 contains a ring opening 90 for inserting ring 70 and also at least one strap opening(s) 20 for inserting strap(s) 50. The ring opening 90 is a sleeve sized to accept ring 70. Ring opening 90 and therefore also ring 70 are located proximal to strap opening(s) 20 so that strap(s) 50, when secured to cuff 10 in the assembled state, will pass through and around ring 70.

The ring 70 must be sufficiently strong to provide structure to the cuff 10 and yet be able to open to be placed around the shaft 170. Therefore, the ring 70 can be hinged and made of a rigid material or made of a flexible material allows the ring to open that still provides structure to the cuff 10 while substantially maintaining its shape. Ring 70 is intended to provide structure and not deform once the anti-inversion apparatus 100 is attached to an umbrella and adjusted to the desired tension. Ring 70 is also lockable so that it remains in the closed position except during installation and removal of the cuff 10 from the umbrella.

Strap opening(s) 20 are spaced around the cuff 10 and sized to accept strap(s) 50. In different embodiments, the openings may be a different size and shape and quantity and may be reinforced as necessary to maintain the shape of the opening. Fastener(s) **40*b* are attached to one distal end of the cuff 10 and the other matching piece of fastener(s) 40*b* is attached to the opposite distal end. While in use, the cuff 10 forms a diameter when the cuff fasteners 40*b* join the distal ends of cuff 10 together. The fastener(s) 40*b*** may include, but are not limited to, VELCRO®, buttons, snaps, etc. or any other means used for temporarily joining two objects together.

Arching strap 30 is used to for attaching the cuff 10 to an umbrella. Arching strap 30, like the cuff, is made of a flexible yet inelastic material. Arching strap 30 may be fully removable from the cuff 10 or it may be permanently attached to the cuff 10 on one or both sides. In this first embodiment, there is a single arching strap 30 that is permanently attached to one side of the cuff so that arching strap 30 always remains with cuff 10. The arching strap 30 has an arch fastener 40*a* for fastening the arching strap 30 to the cuff 10 while in use. While not shown in the figure, if the arching strap 30 is permanently attached to the cuff 10 on opposite sides of cuff 10 in the assembled state, the arching strap 30 may comprise two separate strap portions and additionally may comprise an arch fastener 40*a* which allows each portion of the arching strap 30 to attach to the other portion at some convenient location in the middle.

Figure 2:
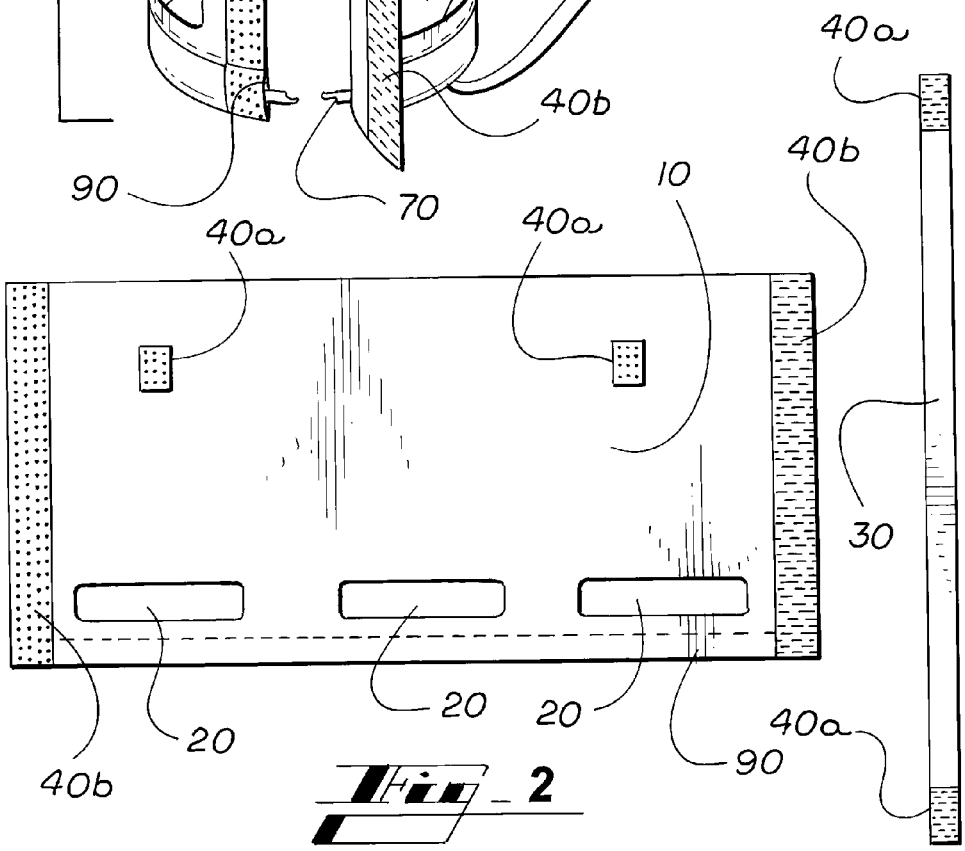
FIG. 2 is an expanded view of the anti-inversion of one portion of the apparatus according to this invention.

FIG. 2 illustrates an exploded view of the anti-inversion apparatus 100 while laid flat without ring 70 and arching strap 30 attached. The strap opening(s) 20 are at a position relative to the bottom of the cuff 10 and proximal to ring opening 90. The strap opening(s) 20 are in multiple locations so as to have multiple attachment points for strap(s) 50.

FIG. 2 also shows the ring opening 90 positioned along the bottom of the cuff 10 for insertion of a ring 70 which provides shape, form, and stability of the cuff 10 when in use. FIG. 2 further shows arch fasteners 40*a* positioned on opposite sides of the upper portion of the cuff 10 for the attachment to arch fasteners 40*a* positioned on each end of the arching strap 30 in order to position the cuff 10 proximally to an umbrella runner 120. FIG. 2 also shows cuff fasteners 40*b* positioned opposite ends of the cuff 10 to join the cuff 10 together when in use.

Figure 3:
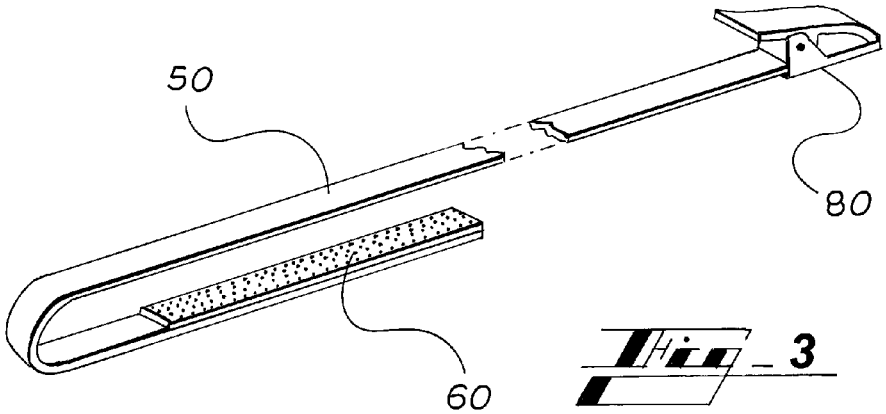
FIG. 3 is perspective view of the adjustable straps of the anti-inversion apparatus according to this invention.

FIG. 3 illustrates the strap(s) 50 according to this invention. The strap(s) 50 has connector(s) 80 at one end and a fastening means 60 at another end. The connector(s) 80 is made of a rigid material that is sufficiently strong for attaching strap(s) 50 to a tip 110 of the umbrella. The connector(s) 80 can be items usable to securely attach the strap(s) 50 to the tip 110 of the umbrella, such as but not limited to a clip, loop, clasp, hook or VELCRO™, etc. The fastening means 60 is used to securely fasten the strap(s) 50 to the cuff 10 while providing for adjustability of the strap(s) 50 to provide adequate force between the anti-inversion apparatus 100 and tip 110.

FIG. 4 illustrates the anti-inversion apparatus 100 attached to a traditional umbrella according to this invention. Because most umbrellas shafts 170 are circular, the ring will mimic the shape of the umbrella shaft 170. Other shapes of the ring 70, such as but not limited to triangles and squares are also possible. During use of the anti-inversion apparatus 100, the arching strap 30 is placed through and over the stretcher(s) 160. Once the arching strap 30 has been strung through the stretcher(s) 160, it may then be attached to the cuff 10 via fastening means 40*a*.

During use, each strap(s) 50 is looped through the strap opening(s) 20, around the ring 70 and attached back to itself via the adjustable means 60. The opposite end of the strap(s) 50 is then connected to the tip 110 via a connector(s) 80. Looping the strap(s) 50 through the strap opening(s) 20 and attaching and adjusting strap(s) 50 creates tension between the cuff 10 and the tip 110, thereby enabling the umbrella to withstand strong winds. The length of the strap(s) 50 between the cuff 10 and the tip 110 can be adjusted via the strap adjustable means 60. As a result, the anti-inversion apparatus can accommodate different size and proportioned umbrellas. The number of strap(s) 50 may be increased or decreased in order to accommodate larger or smaller umbrellas or to provide greater resistance in efforts to prevent umbrella inversion.

FIG. 5 illustrates a bottom view of the anti-inversion apparatus installed the traditional umbrella according to this invention. The strap(s) 50 extend radially from the cuff 10 to any one of the adjacent tips 110, and are connected to the tips 110 via connectors 80. It is preferred that the attachment points of the strap(s) 50 to the tips 110 be directly in line with the strap opening(s) 20, allowing the strap(s) 50 to provide adequate force against the tips 110, thereby creating extra stability for the umbrella canopy 150. It is possible for each strap(s) 50 to be connected to each tip 110 of the umbrella and connect to the cuff 10 utilizing the strap opening(s) 20 on the cuff 100. Because each strap(s) 50 may connect to each tip 110, the one-to-one ratio may allow for ease of assemble and disassembly. The strap adjustable means 60 also aids in increased tension by allowing a user to adjust each strap to his/her desired tension level, thus accommodating different size and proportioned umbrellas.

FIG. 6 displays a bottom view of the apparatus 100 installed on the traditional umbrella using Y-shaped strap(s) 55. The Y-shaped strap(s) 55 are on one end each connected to the cuff 10 as similarly discussed above. On the other end, each of the two ends connects to each of two separate tips 110 of the umbrella via connectors 80. Each strap(s) 55 extends radially from the cuff 10 and then branches out to create the Y-shape and then connects to the tips 110, thereby creating extra stability for the umbrella canopy 150. This set-up reduces the total strap-to-tip ratio. The Y-shaped strap(s) 55 in general, when positioned through the strap opening(s) 20 of the cuff 10, create a more stable umbrella canopy 150 during windy conditions as a result of the strap-to-tip ratio. The Y-shaped strap(s) 55 also provide an additional benefit; if one connector 80 fails, the other connector 80 on the Y-shaped strap(s) 55 still provides support.

Figure 7:
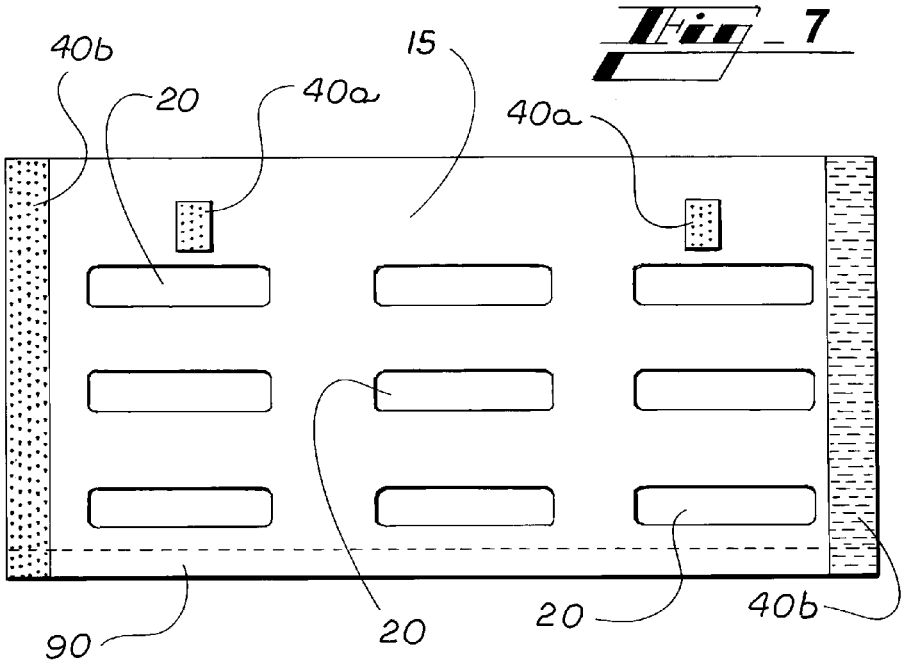
FIG. 7 is a side view of an alternate cuff having multiple openings and attachment points in accordance with one embodiment of this invention.
Figure 8:
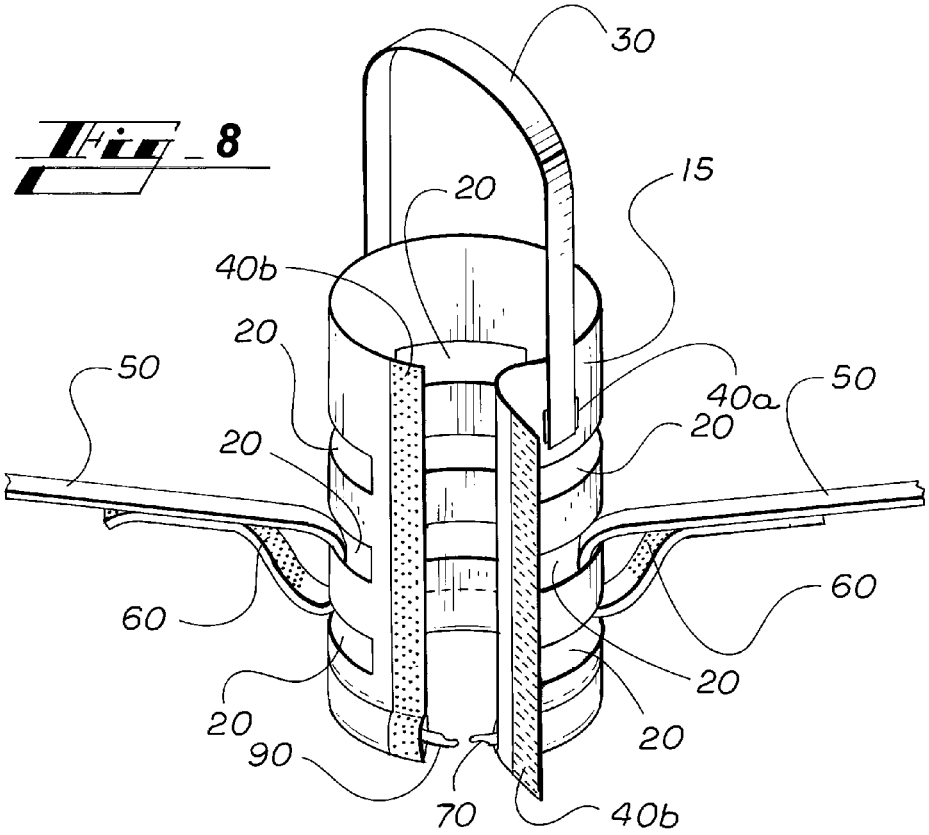
FIG. 8 is a perspective view of the alternate cuff of FIG. 7 with other components of the anti-inversion apparatus attached.

FIGS. 7 and 8 illustrate an alternate embodiment of the anti-inversion apparatus 100, according to this invention. This embodiment contains multiple strap opening(s) 20 horizontally and vertically spaced along cuff 15. As shown in FIG. 8, the multiple strap opening(s) 20 of the cuff 15 allow for the adjustability of the strap(s) 50 (or Y-shaped straps 55, of FIG. 6) providing compatibility for various sized umbrellas and adjustment of the tension between the anti-inversion apparatus 100 and the canopy 150 of an umbrella.

The multiple strap opening(s) 20 also allow a user to vary the angle relative to the shaft 170 at which he/she attaches the straps to the cuff 15. The varied angles create varied tension which will aid in the prevention of umbrella inversion during high winds.

Yet another embodiment of the anti-inversion apparatus, not directly described in the figures but within the scope of the subject invention, would eliminate the need for the aforementioned ring 70 or arching strap 30 or both by sizing the cuff such that it wraps tightly enough around the umbrella shaft 170 such that one or both are no longer needed but not necessarily so tight that umbrella could not be folded and stored with cuff around shaft. In this embodiment, the shaft would help the cuff maintain its shape, eliminating the need for the ring, and the cuff fastener would replace the locking feature of ring 70 by being sufficiently strong to the keep the cuff around the shaft except when installing or removing the apparatus.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention claimed is:

1. An anti-inversion apparatus for an umbrella comprising:

a. a removable cuff comprising:

1. at least one strap opening for accepting at least one strap;
2. a cuff fastener for securing the removable cuff to itself around a shaft of the umbrella; and
3. at least one ring integrated into the removable cuff via a ring opening of the removable cuff, wherein the at least one ring comprises a rigid material to provide structure to the removable cuff, and wherein the at least one ring and the removable cuff encircle the shaft of the umbrella;

b. at least one strap comprising:

1. a first end having a fastening means, wherein the first end is attachable to the removable cuff through the at least one strap opening and secured using the fastening means, wherein the strap opening is separate from the ring opening;
2. a second end having a connector; and c. an arching strap for securing the removable cuff to the umbrella, wherein the arching strap is perpendicular to a top of the removable cuff.

2. The apparatus of claim 1, wherein the at least one strap is adjusted to a tension to provide force against an umbrella tip so as to prevent inversion of the umbrella.

3. The apparatus of claim 1, wherein the at least one ring contains a locking mechanism for maintaining the at least one ring in a closed position when the removable cuff is attached to the shaft of the umbrella.

4. The apparatus of claim 1, wherein the arching strap loops through at least one rib and around an umbrella runner for securing the apparatus to the umbrella.

5. The apparatus of claim 1, wherein the at least one strap is Y-shaped.

6. The apparatus of claim 5, wherein the Y-shaped straps comprise: the first end, the second end and a third end having a connector, wherein the second and third ends are attached to multiple umbrella tips.

7. The apparatus of claim 1, wherein the at least one strap is attached to the removable cuff and extend radially from the removable cuff to at least one umbrella tip and attaches to the at least one tip via a connector.

8. The apparatus of claim 1, wherein the removable cuff has multiple strap openings positioned at locations to adjust the angles between the attachment point of the strap and the umbrella tip.

9. A method for preventing inversion of an umbrella comprising:

a. placing a removable cuff on an umbrella and securing the removable cuff around an umbrella shaft with a locking ring and cuff fastener wherein the locking ring comprises a rigid material to provide structure to the removable cuff;

b. placing at least one strap into a strap opening and securing the strap in the Opening, wherein the strap opening is in the removable cuff and separate from a ring opening;

c. clipping the strap to an umbrella tip and adjusting the strap with a strap fastening means to a tension to prevent umbrella inversion; and d. placing an arching strap through an umbrella rib and around an umbrella runner, wherein the arching strap is perpendicular to a top of the removable cuff.

10. The method of claim 9, wherein the at least one strap is Y-shaped.

11. The method of claim 10, wherein attaching the Y-shaped straps comprises attaching a first end of the strap through the strap opening and clipping the second end and a third to multiple different tips of the umbrella and adjusting the strap to provide tension to prevent umbrella inversion.

12. The method of claim 9, wherein when the removable cuff has multiple strap openings positioned at different vertical locations, adjusting the angles between where the strap attaches and the umbrella tip so as to vary the amount of tension placed on the umbrella tip to prevent inversion of the umbrella.

13. An anti-inversion apparatus for an umbrella comprising:

e. a removable cuff comprising:

i. at least one strap opening for accepting at least one strap; and
ii. a cuff fastener for securing the removable cuff around a shaft of the umbrella;
iii. at least one ring integrated into the removable cuff via a ring opening of the removable cuff, wherein the at least one ring comprises a rigid material to provide structure to the removable cuff; and f. at least one strap comprising:

i. a first end having a fastening means, wherein the first end is attachable to the removable cuff through the at least one strap opening and secured using the fastening means;
ii. a second end having a connectors;
iii. wherein the at least one strap opening is separate from the ring opening; and
iv. at least one arching strap for securing the removable cuff to the umbrella, wherein the arching strap is perpendicular to the top of the removable cuff.

14. The apparatus of claim 13, wherein the cuff fasteners comprise straps that extend from the cuff.

15. The apparatus of claim 13, wherein the at least one strap is Y-shaped.

16. The apparatus of claim 15, wherein the Y-shaped straps comprise: the first end, the second end and a third end having a connector, wherein the second and third ends are attached to multiple umbrella tips.

17. The apparatus of claim 13, wherein the removable cuff has multiple strap openings positioned at locations to adjust the angles between the attachment point of the strap and the umbrella tip.

* * * * *